United States Patent [19]

Tsukahara et al.

[11] Patent Number: 4,699,103

[45] Date of Patent: Oct. 13, 1987

[54] FUEL INJECTION SYSTEM

[75] Inventors: Kenji Tsukahara, Oobu; Taizou Abe, Chiryu, both of Japan

[73] Assignee: Nippondenso Co., Ltd., Kariya, Japan

[21] Appl. No.: 822,522

[22] Filed: Jan. 27, 1986

[30] Foreign Application Priority Data

Jan. 28, 1985 [JP] Japan ..... 60-13766

[51] Int. Cl.[4] ..... F02M 43/00

[52] U.S. Cl. ..... 123/304; 123/575; 123/498; 123/497

[58] Field of Search ..... 123/304, 299, 300, 575, 123/472, 498, 499, 497

[56] References Cited

U.S. PATENT DOCUMENTS

| | | | |
|---|---|---|---|
| 1,419,231 | 6/1922 | Crossley | 123/304 |
| 1,857,256 | 5/1932 | Nordberg | 123/304 |
| 3,308,794 | 3/1967 | Bailey | 123/575 |
| 3,501,099 | 3/1970 | Benson | 123/472 |
| 3,749,097 | 7/1973 | Grow | 123/304 |
| 4,180,022 | 12/1979 | Khair | 123/472 |
| 4,416,229 | 11/1983 | Wood | 123/304 |
| 4,481,921 | 11/1984 | Tsukahara et al. | 123/304 |
| 4,520,774 | 6/1985 | Sitter | 123/575 |

*Primary Examiner*—Ronald B. Cox

*Attorney, Agent, or Firm*—Cushman, Darby & Cushman

[57] ABSTRACT

A fuel injection system according to the present invention comprises a fuel injection nozzle for injecting a supplementary fuel prior to injection of a main fuel, a distributor-type fuel injection pump for supplying the main fuel to the nozzle, a supplementary fuel feed pump for delivering the supplementary fuel to the nozzle, a relief valve for adjusting the pressure of the fuel from the feed pump to a fixed level, and a supplementary fuel feed valve disposed between the relief valve and the nozzle. The open period of the feed valve is controlled in accordance with the operating state of the engine.

11 Claims, 7 Drawing Figures

FUEL INJECTION SYSTEM

BACKGROUND OF THE INVENTION

The present invention relates to a fuel injection system for supplying combustion chambers of a diesel engine with a supplementary fuel, such as light oil, before feeding a main fuel, e.g., alcohol.

While light oil is conventionally used for the fuel of a diesel engine, alcohol has recently been tried as a substitute for light oil. If alcohol, a synthetic product, were used in place of light oil, which is obtained from petroleum, then those natural resources could be conserved.

Unlike light oil, however, alcohol does not permit satisfactory compression ignition in the combustion chambers of the diesel engine. If alcohol is used as a main fuel for the diesel engine, therefore, light oil must be used as a supplementary fuel.

Disclosed in U.S. Pat. No. 4,481,921, for example, is a fuel injection system in which two kinds of fuels can be fed into the combustion chambers of a diesel engine. In this system, main and supplementary fuels delivered from a fuel injection pump and a supplementary fuel feed device, respectively, are supplied to fuel injection nozzles disposed individually in the combustion chambers of the engine. The supplementary fuel feed device includes a plunger which is reciprocated by the pressure of the main fuel delivered from the pump. The reciprocation of the plunger causes a pumping action to feed the supplementary fuel to the fuel injection nozzle.

In this supplementary fuel feed device, however, the stroke of the plunger is fixed, so that the quantity of supplementary fuel supplied to the nozzle with every stroke is constant. According to the prior art fuel injection system, therefore, it is impossible to control the supplementary fuel supply to the fuel injection nozzle in accordance with the operating state of the engine.

SUMMARY OF THE INVENTION

The object of the present invention is to provide a fuel injection system capable of controlling, in accordance with the operating state of a diesel engine, the quantity of supplementary fuel injected into the combustion chambers of the engine prior to the main fuel injection.

The above object of the invention is achieved by a fuel injection system for supplying a combustion chamber of a diesel engine with main and supplementary fuels, comprising a fuel injection nozzle through which the supplementary fuel is injected into the combustion chamber prior to the main fuel injection, a main fuel injection pump connected to the fuel injection nozzle to supply the same with the main fuel, the pump being capable of controlling the main fuel supply in accordance with the operating state of the engine, a supplementary fuel feed pump for delivering the supplementary fuel, and a feed device for supplying the fuel injection nozzle with the supplementary fuel delivered from the supplementary fuel feed pump, the feed device including a passage connecting the fuel injection nozzle and the supplementary fuel feed pump, adjusting means provided in the passage and adapted to adjust the pressure of the supplementary fuel supplied to the fuel injection nozzle to a predetermined pressure, a feed valve provided in that portion of the passage located nearer to the fuel injection nozzle than the adjusting means is, whereby the passage is opened and closed, and driving means for electrically controlling the operation of the feed valve in accordance with the operating state of the engine.

According to the fuel injection system of the invention described above, the pressure of the supplementary fuel supplied to the fuel injection nozzle is adjusted to the predetermined level by the adjusting means. Therefore, the open period of the feed valve can be proportioned to the supplementary fuel supply to the nozzle. Thus, the supplementary fuel supply to the nozzle can easily be controlled in accordance with the operating state of the engine by adjusting the valve-open period through the medium of the driving means.

The supplementary fuel can be supplied to the fuel injection nozzle directly after the feed valve is opened. Therefore, the valve opening timing or the timing for the supplementary fuel supply can also be controlled in accordance with the engine state. Accordingly, the supplementary fuel can be supplied to the nozzle immediately before the main fuel is fed from the main fuel injection pump to the nozzle. Thus, the possibility of the main and supplementary fuels being mixed in the fuel injection nozzle can be minimized, enabling the nozzle to reliably perform injection of the supplementary fuel prior to the main fuel injection.

DETAILED DESCRIPTION OF THE PREFERRED EMBODIMENTS

Figure 1:
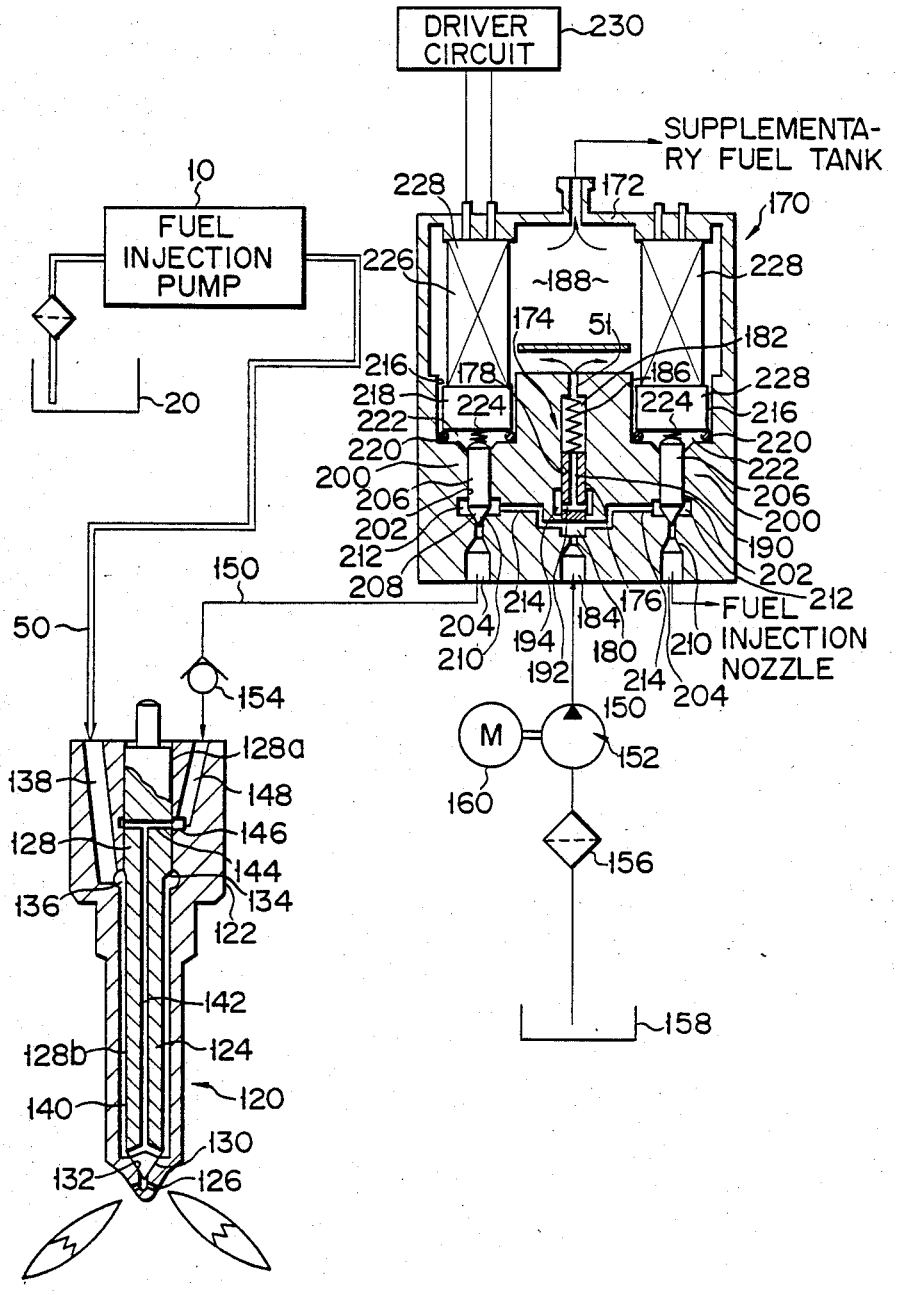
FIG. 1 is a schematic view of a fuel injection system according to a first embodiment of the present invention.
Figure 2:
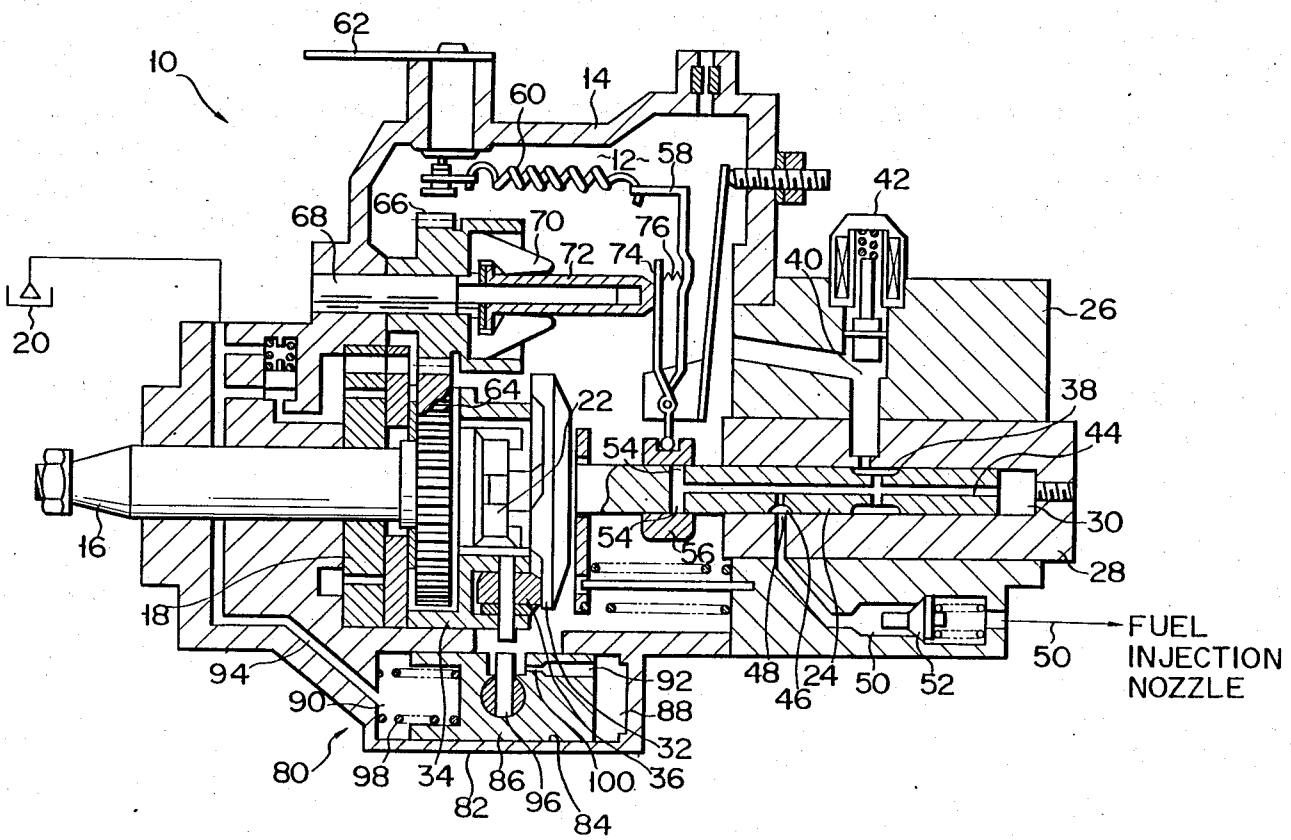
FIG. 2 is a sectional view of a fuel injection pump used in the system of FIG. 1.

Referring now to FIGS. 1 and 2, there is shown a fuel injection system for injecting two different fuels into combustion chambers of a diesel engine. The system includes a fuel injection pump such as that 10, as shown in FIG. 2. The construction of pump 10, which is conventional, will now be described only briefly.

Fuel injection pump 10 has pump housing 14 which defines main fuel supply chamber 12. Drive shaft 16 is rotatably supported in housing 14. One end of shaft 16 projects from housing 14 and is coupled to a transmission system (not shown) so that shaft 16 is rotated by the engine through the medium of the transmission system.

Drive shaft 16 is fitted with feed pump 18. Pump 18 feeds main fuel, in this case alcohol, from fuel tank 20 into fuel supply chamber 12. Here it is to be noted that the fuel pressure inside chamber 12 varies with the rotating speed of pump 18.

The other end of drive shaft 16, which is located within fuel supply chamber 12, is connected to one end of plunger 24 by means of coupling 22. Plunger 24 is slidably fitted in distributor head 26 attached to pump housing 14. More specifically, cylinder 28 is held in head 26, and plunger 24 is slidably fitted in cylinder 28.

Inside cylinder 28, pump chamber 30 is defined between the other end face of plunger 24 and the inner end face of cylinder 28 facing each other. Face cam 32 is mounted on plunger 24, which are rotatable together and located on the coupling side. Cam 32 is slidably in contact with rollers 36 of roller ring 34. Ring 34 is supported on the inner wall of pump housing 14 for rotation around the axis of plunger 24. Rollers 36 of ring 34, in cooperation with face cam 32, reciprocate plunger 24 within cylinder 28 as plunger 24 is rotated together with drive shaft 16. For each revolution of plunger 24, one stroke is produced for each cylinder of the engine. To effect these actions by plunger 24, coupling 24 must serve not only to transmit the rotation of shaft 16 to plunger 24, but also to allow axial movement of plunger 24 relative to shaft 16.

Inlet grooves 38, of which one corresponds to each engine cylinder, are formed on that portion of the outer peripheral surface of plunger 24 inside cylinder 28 and arranged circumferentially at regular intervals. As plunger 24 rotates, grooves 38 successively connect with inlet passage 40 which is formed in distributor head 26 and cylinder 28. Passage 40 is connected to fuel supply chamber 12 at all times. Solenoid valve 42 for opening and closing passage 40 is provided in the middle of passage 40.

Inlet grooves 38 are all connected to center hole 44 in plunger 24. One end of hole 44 opens into pump chamber 30. Hole 44 is connected to distribution groove 46 which is located closer to face cam 22 than grooves 38 are. Groove 46 opens to the outer peripheral surface of plunger 24. As plunger 24 rotates, groove 46 is connected in succession to distribution ports 48 which open to the inner peripheral surface of cylinder 28 and are arranged circumferentially at regular intervals. Ports 48 are connected individually to distribution passages 50 formed in cylinder 28 and distributor head 26. Passages 50 are each provided with delivery valve 52 in distribution head 26. Ports 48 and passages 50, only one of which is shown in FIG. 2, correspond in number to the engine cylinders.

The operation of fuel injection pump 10 with the aforementioned construction will now be described. When plunger 24 rotates through a certain rotational angle, while moving in the direction to increase the volume of pump chamber 30, so that one inlet groove 38 connects with inlet passage 40, the fuel in fuel supply chamber 12 is fed into chamber 30 via groove 38 and center hole 44. At this time, distribution groove 46 is not connected any distribution passage 50. Therefore, when plunger 24, while rotating, then moves in the direction reducing the volume of chamber 30, the fuel in chamber 30 is pressurized by plunger 24. When plunger 24 rotates through a predetermined angle during this compression stroke in chamber 30 so that groove 46 is connected to one of passages 50, the fuel pressurized in pump chamber 30 is discharged therefrom through hole 44, groove 46, passage 50, and valve 52. By repeating these processes, pressurized fuel is delivered successively to the individual distribution passages.

The fundamental pumping action of fuel injection pump 10 has been described above. Pump 10 is provided with a metering device for adjusting the quantity of pressurized fuel delivered from pump chamber 30 in accordance with the depth of depression of the accelerator pedal and the engine speed. The metering device will be described below.

A plurality of spill ports 54 are formed in that portion of the outer peripheral surface of plunger 24 which is exposed in fuel supply chamber 12. Ports 54 are arranged at regular intervals in the circumferential direction of plunger 24, and connected to center hole 44 of plunger 24. Spill ring 56 is slidably fitted on the outer peripheral surface of plunger 24 so as to close ports 54. Ring 56 is coupled with one end of tension lever 58, the other end of which is connected to adjusting lever 62 by means of main spring 60. Lever 62 is connected to the accelerator pedal by means of a linkage (not shown) so that lever 62 rocks in association with the operation of the pedal. When lever 62 rocks in accordance with the depth of depression of the accelerator pedal, tension lever 58 is rocked through the medium of spring 60. Thus, the axial position of spill ring 56 on the outer peripheral surface of plunger 24 can be adjusted.

According to this metering device, when plunger 24 is moved to the right of FIG. 2 by a predetermined distance, during a delivery stroke for the pressurized fuel delivered from pump chamber 30 to passage 50, spill ports 54 of plunger 24 come out of spill ring 56 to be connected to fuel supply chamber 12. When ports 54 connect with chamber 12 in this manner, the fuel pressure inside pump chamber 30 drops suddenly. At this point of time, therefore, the delivery of the pressurized fuel from chamber 30 is stopped. This is the means by which the quantity of fuel delivered from fuel injection pump 10 is determined.

As seen from the above description of the function of spill ring 56, if ring 56 is moved to the right of FIG. 2 on plunger 24, aided by adjusting lever 62, main spring 60 and tension lever 58, the timing at which spill ports 54 are open to fuel supply chamber 12 will be delayed during the fuel delivery stroke. In this case, the quantity of fuel delivered from fuel injection pump 10 is increased. If ring 54 is moved to the left on plunger 24, on the other hand, ports 54 are opened earlier, so that the amount of pressurized fuel from pump 10 is decreased.

A mechanism for adjusting the fuel delivery according to the engine speed will now be described. Driving gear 64 is mounted on that portion of driving shaft 16 between feed pump 18 and coupling 22. Gear 64 is meshed with driven gear 66 mounted on rotating shaft 68 which is rotatably supported by pump housing 14. A pair of fly-weights 70 are attached to gear 66. Fly-weights 70 radially spread outside shaft 68 in accordance with the rotational frequency of driven gear 66 rotated by driving gear 64 on shaft 16. Thus, fly-weights 70 push governor sleeve 72 which is slidably mounted on shaft 68. The distal end of sleeve 72 abuts control lever 74, which is coupled to spill ring 56. Thus, when the rotational frequency of driven gear 66 or the engine speed increases so that sleeve 72 is moved to the right as seen in FIG. 2 by fly-weights 70, lever 74 is rocked to move spill ring 56 to the left on plunger 24. In this case, the axial position of ring 56 on plunger 24 and hence the quantity of pressurized fuel delivered from fuel injection pump 10 is adjusted to correspond to the increase in engine speed. When the engine speed is decreased, governor sleeve 72 returns to its original position by the force of return spring 76 which is disposed between control lever 74 and tension lever 58.

In addition to the above described metering device, fuel injection pump 10 is further provided with timer 80 for adjusting the timing for the delivery of pressurized fuel from pump 10. Timer 80 has housing 82 formed integrally with pump housing 14. Cylinder bore 84 is defined inside timer housing 82, and timer piston 86 is fitted in bore 84. Piston 86 divides the inside of bore 84 into two chambers 88 and 90. First chamber 88 is connected to fuel supply chamber 12 by means of passage 92 which is defined in piston 86 and pump housing 14. Passage 92 is provided with restriction portion 100. Thus, the fuel pressures inside chambers 88 and 12 are equal. Second chamber 90 is connected to fuel tank 20 by means of passage 94 which is defined in housing 14. Chamber 90 contains therein coil spring 98 for urging piston 86 toward chamber 88. Piston 86 is connected to roller ring 34 by connecting rod 96. As piston 86 moves, ring 34 rotates around the axis of plunger 24. In FIG. 2, rod 96 is only partially shown, and timer piston 86 and plunger 24 are arranged parallel to each other for the ease of illustration. Actually, however, piston 86 extends at a right angle to plunger 24.

According to timer 80 described above, if the fuel pressure inside fuel supply chamber 12 rises with an increase in engine speed, the fuel pressure in first chamber 88 rises correspondingly. The pressure increase inside chamber 88 causes timer piston 86 to move toward second chamber 90 due to the force of coil spring 98. This movement of piston 86 is converted into rotational movement of roller ring 34 by connecting rod 96. As ring 34 is rotated in this manner, the phase angle between face cam 32 and cam roller 36 contacting each other changes, so that the timing for the reciprocation of plunger 24 relative to its rotation varies. Thus, the timing for the delivery of the pressurized fuel from pump 10 can be adjusted in accordance with engine speed.

As described above, distributor-type fuel injection pump 10 can control the delivery timing as well as the delivery of pressurized fuel.

Referring again to FIG. 1, distribution passages 50 of fuel injection pump 10 are connected respectively to fuel injection nozzles 120 disposed in the individual combustion chambers of the engine. In FIG. 1, one of passages 50 and its corresponding nozzle 120 are shown only partially. Nozzle 120 has body 122 formed with axially extending guide bore 124. Injection holes 126 connecting with bore 124 open at the tip end of nozzle body 122. Nozzle needle 128 is disposed in bore 124. Needle 128 is formed of large-and small-diameter portions **128*a* and 128*b* on the upper and lower sides (FIG. 1), respectively. Portion 128*a* is slidably fitted in guide bore 124. Needle seat 130 is formed at the lower end of needle 128. Nozzle body 122 is formed with body seat 132 for closing injection holes 126 in cooperation with seat 130. Needle 128 is continually urged downward by a pressure spring (not shown) so that seats 130 and 132 abut each other and thereby close holes 126**.

As seen from FIG. 1, tapered pressure stage 134 is formed on the boundary between large- and small-diameter portions **128*a* and 128*b* of nozzle needle 128. Annular groove 136 is formed on the inner peripheral surface of guide bore 124, surrounding stage 134. Groove 136 is connected to distribution passage 50 of fuel injection pump 10 by means of main fuel passage 138 formed in nozzle body 122. Thus, the main fuel delivered from pump 10 is supplied through passage 138 to groove 136 and annular chamber 140 which is defined between the outer peripheral surface of portion 128*b* of needle 128 and the inner peripheral surface of bore 124. If the pressure inside annular groove 136 reaches or exceeds a predetermined level, needle 128 is lifted to open injection holes 126, so that the main fuel is injected into the combustion chamber through holes 126**.

Internal passage 142 is defined in nozzle needle 128. The lower end of passage 142 opens above nozzle seat 130 and connects with annular chamber 140. The upper end of passage 142 opens to the outer peripheral surface of large-diameter portion **128*a* of needle 128 via radial holes 144**.

In the state shown in FIG. 1, the inner peripheral surface of guide bore 124 is formed with annular groove 146 which connects with radial hole 144. Groove 146 is connected to connecting passage 148 formed in nozzle body 122. Passage 148 is connected to supplementary fuel feed pump 152 by means of supplementary fuel supply passage 150. Passage 150 is provided with check valve 154 located on the side of fuel injection nozzle 120, whereby the fuel is prevented from flowing from nozzle 120 to pump 152.

Supplementary fuel feed pump 152 is connected to supplementary fuel tank 158 through filter 156. Tank 158 contains light oil as a supplementary fuel. Pump 152 is a conventional fixed delivery pump which is driven by, for example, electric motor 160. To replace motor 160, a crankshaft of the engine may be used as a drive source for pump 158.

Supplementary fuel supply passage 150 is provided with control device 170 for controlling the supplementary fuel supply, located between check valve 154 and feed pump 152. Device 170 will now be described in detail.

Control device 170 is provided with control housing 172. Relief valve 174 is provided in the lower central portion of housing 172. Valve 174 includes valve member 176 which is slidably fitted, in a liquid-tight manner, in cylinder bore 178 defined in housing 172. Member 176 divides the inside of bore 178 into two chambers 180 and 182. First chamber 180 is connected to supplementary fuel feed pump 152 by means of connecting hole 184. Second chamber 182 contains coil spring 186, which presses valve member 176 downward (FIG. 1) with a predetermined force. Chamber 182 communicates with cooling chamber 188 in control housing 172 by means of a passage. Chamber 188 connects with supplementary fuel feed tank 158 by means of return passage (not shown).

Valve member 176 is formed with escape passage 190, one end of which opens into second chamber 182. The other end of passage 190 is connected to escape ports 192 which open to the outer peripheral surface of member 176. Annular groove 194 is formed in the inner peripheral surface of cylinder bore 178. In the state of FIG. 1, groove 194 communicates with ports 192. The width of groove 194 in the axial direction of member 176 is long enough to allow groove 194 and ports 192 to connect normally even though member 176 is lifted and its lower end face passes above the lower edge of groove 194.

Control housing 172 contains a plurality of supplementary fuel feed valves 200 arranged circumferentially at regular intervals around relief valve 174. Valves 200 have the same construction and correspond in number to the engine cylinders.

Cylinder bore 202 is formed in control housing 172, extending parallel to cylinder bore 178. The lower end of bore 202 is connected to supplementary fuel passage 150 by means of passage 204. Valve member 206 is slidably fitted in bore 202, but is not extremely tightly fitted. The lower end of member 206 forms tapered valve seat 208, which engages seat face 210 at the upper portion of passage 204, thereby closing passage 204. Annular groove 212 is formed in the inner peripheral surface of bore 202, surrounding the lower end portion of valve member 206. Groove 212 is connected to first chamber 180 of relief valve 174 by means of distribution passage 214.

Control housing 172 is formed with cylinder bore 216 which, having a greater diameter than that of cylinder bore 202, is connected straight to the upper end of bore 202. Power piston 218 is fitted in bore 216. O-ring 220 is disposed at a stepped portion between bores 216 and 202. Thus, when piston 218 is lowered, it is elastically supported by ring 220. Pump chamber 222 is defined in bore 216 by ring 220, the lower end face of piston 218 and the stepped portion. Inside chamber 222, coil spring 224 is interposed between the lower end face of piston 218 and the upper end face of valve member 206. Spring 224 urges member 206 downward.

Actuator 226 is disposed in cooling chamber 188, connected directly to power piston 218. It serves to reciprocate piston 218. Actuator 226 includes cylindrical member 228 (hereinafter referred to simply as PZT stack) which is formed by stacking a plurality of disks made of, e.g., lead zirconate titanate. In this embodiment, PZT stack 228 stretches longitudinally or in the axial direction of power piston 218 when it is placed in an electric field. If the electric field is removed, stack 228 is restored to its original height. Actuator 226 is not limited to PZT stack 228, and may alternatively include a cylindrical member which is formed by stacking a plurality of disks made of barium titanate.

PZT stack 228 is electrically connected to drive circuit 230. Normally, circuit 230 applies an electric field to stack 228. Depending on the operating state of the engine, however, it may serve to remove the electric field from stack 228. The operating state of the engine is determined by signals from various detectors for detecting the engine speed, lubricating oil temperature, cooling water temperature, throttle valve opening, outside air temperature, exhaust gas temperature, etc.

The operation of the fuel injection system will now be described. The supplementary fuel or light oil in supplementary fuel tank 158 is drawn and fed through connecting hole 184 into control device 170, i.e., first chamber 180 of relief valve 174, by supplementary fuel feed pump 156. The fuel fed into chamber 180 is then supplied to annular groove 212 of each supplementary fuel feed valve 200 via distribution passage 214. The fuel supplied to grooves 212 is kept at a fixed pressure. If the pressure of the supplementary fuel supplied to chamber 180 of valve 174 rises above a predetermined level, it causes valve member 176 of valve 174 to be lifted against the urging force of coil spring 186, thereby connecting chamber 180 and annular groove 194. As a result, the fuel in chamber 180 runs into cooling chamber 188 through groove 194, escape ports 192 in valve member 176, and escape passage 190. Thus, the pressure of the supplementary fuel supplied from first chamber 180 to grooves 212 of feed valves 200 is kept at the fixed pressure which is adjusted by the force of spring 186. Although the force of spring 186 is fixed in this embodiment, it may alternatively be made adjustable. The fuel delivered from first chamber 180 of relief valve 174 to cooling chamber 188 is also used to cool PZT stacks 228 of feed valves 200 in chamber 188.

In the state shown in FIG. 1, valve seat 208 of valve member 206 is seated on seat face 210, so that the fixed-pressure supplementary fuel supplied to annular groove 212 of each supplementary fuel feed valve 200 will never be delivered from groove 212 to passage 204. Accordingly, the fuel in groove 212 flows into pump chamber 222 through the gap between the outer surface of valve member 206 and the inner surface of cylinder bore 202. Since part of seat 208 of valve member 206 is in contact with seat face 210, the effective pressure receiving area of the upper end face of member 206 is wider than that of the lower end face. Thus, member 206 is forced down by the pressure of supplementary fuel in pump chamber 222, thereby securely keeping passage 204 closed.

If the electric field being applied to PZT stack 228 of one supplementary fuel feed valve 200, combined with fuel injection valve 120 shown in FIG. 1, is suddenly removed by driver circuit 130, stack 228 diminishes in axial length at once. Accordingly, power piston 218 of valve 200 is lifted in an instant by the pressure inside pump chamber 222. This results in a sudden drop of the pressure inside chamber 222, reducing the force to press down valve member 206. As a result, member 206 is lifted by the pressure inside annular groove 212, causing passage 204 to open. Thus, the supplementary fuel in groove 212 is delivered to fuel injection nozzle 120 through passage 204 and supplementary fuel passage 150. In nozzle 120, the supplementary fuel is supplied to the lower portion of annular chamber 140 via connecting passage 148, annular groove 146, radial hole 144, and internal passage 142. In this case, injection holes 126 are closed by nozzle needle 128, as shown in FIG. 1, so that the fuel supplied to the lower portion of chamber 140 cannot be injected through holes 126. Thus, the pressure from the supplementary fuel contained in the lower portion of chamber 140 near nozzle seat 130 of needle 128 forces up the main fuel in the rest of chamber 140.

Figure 3:
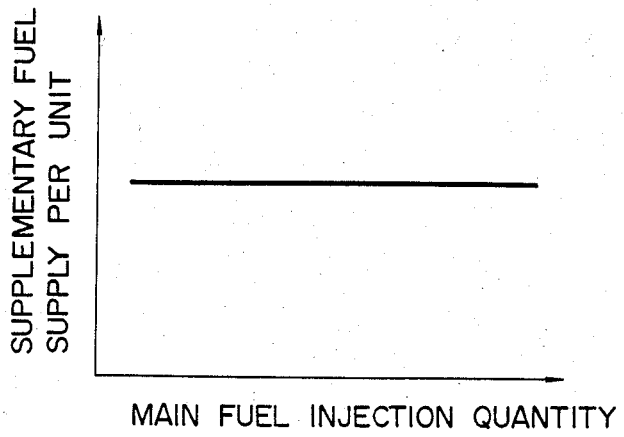
FIGS. 3 and 4 are diagrams for illustrating the function of a supplementary fuel feed valve.
Figure 4:
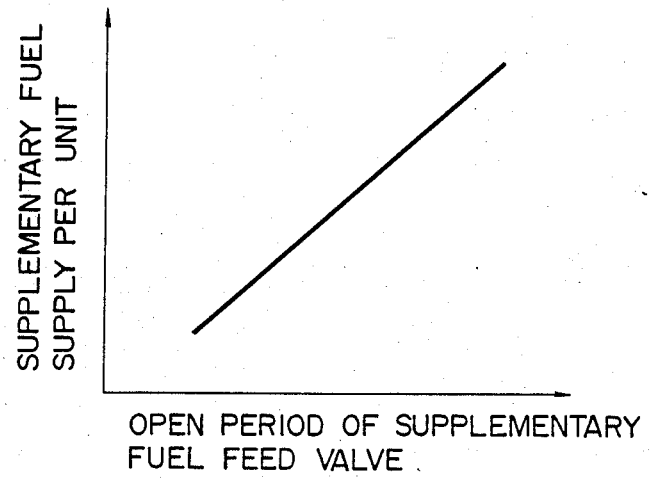

If the electric field is reapplied to PZT stack 228 in the contracted state by driver circuit 230, stack 228 is restored to the stretched state, thereby forcing down power piston 218. Accordingly, the pressure inside pump chamber 222 increases to lower valve member 206. As a result, passage 204 is closed by member 206, when the supplementary fuel supply from supplementary fuel feed valve 200 to fuel injection nozzle 120 is stopped. The supplementary fuel supplied to nozzle 120 is proportional to the period during which passage 204 is closed by member 206 of valve 200, that is, the period when PZT stack 228 is not subjected to any electric field. More specifically, the supplementary fuel fed into annular groove 212 of valve 200 is continually adjusted to the fixed pressure by relief valve 174. If the period valve 200 is opened is fixed, therefore, the quantity of supplementary fuel delivered from valve 200 to nozzle 120 is constant regardless of the main fuel supply from fuel injection pump 10 to nozzle 120 or other factors, as shown in FIG. 3. In FIG. 3, the axis of abscissa represents the quantity of main fuel supplied from pump 10. Thus, the quantity of supplementary fuel supplied from supplementary fuel feed valve 200 to fuel injection nozzle 120 is substantially proportional to the open period of valve 200, as shown in FIG. 4. Therefore, the supplementary fuel supply to nozzle 120 can be controlled by regulating the open period of valve 200, i.e., the period when no electric field is applied to PZT stack 228, in accordance with the operating state of the engine. The process of supplementary fuel supply to nozzle 120 ends in a very short time.

When the supplementary fuel is supplied to fuel injection nozzle 120, that is, when it stands in the lower portion of annular chamber 140 of nozzle 120, the pressurized main fuel or alcohol is supplied from fuel injection pump 10 to main fuel passage 138 and hence annular groove 136 of nozzle 120. In this case, even though the main fuel is supplied to nozzle 120, the supplementary fuel standing in the lower portion of annular chamber 140 of nozzle 120 is prevented from running into control device 170 by check valve 154. Therefore, the main fuel supply to nozzle 120 causes the pressure inside groove 136 to increase, so that nozzle needle 128 is lifted to open injection holes 126 for the first time. Thus, the fuel in annular chamber 140 is injected into the combustion chamber through holes 126. Since the supplementary fuel is standing in the lower portion of chamber 140, it is first forced out through holes 126 by the main fuel, and the main fuel is then injected. Although the process of fuel injection from one fuel injection nozzle 120 to its corresponding combustion chamber has been described, it is to be understood that the same injection process may be for any of the fuel injection nozzles arranged individually in the combustion chambers of the engine.

As described above, the supplementary fuel consisting of light oil, which is higher in compression ignition compared to alcohol as main fuel, is injected into the combustion chambers of the diesel engine before the main fuel, alcohol, is injected. Accordingly, the ignition of the supplementary fuel induces smooth ignition of the main fuel.

According to the fuel injection system of the present invention described above, the use of distributor-type fuel injection pump 10 permits the control of the main fuel supply to fuel injection nozzles 120, i.e., the quantity of main fuel injected into the combustion chambers of the engine, and the main fuel injection timing, in accordance with the operating state of the engine. Also, the supplementary fuel injection prior to the main fuel injection can be controlled in accordance with the engine state. Moreover, the pressure of the supplementary fuel fed into annular grooves 212 of supplementary fuel feed valves 200 of control device 170 is kept at a fixed pressure by means of relief valve 174. Therefore, the supplementary fuel supply to nozzles 120 can be controlled by varying the open period of valves 200, i.e., the period during which PZT stacks 228 are free from an electric field, in accordance with the engine state.

According to supplementary fuel feed valves 200 described above, furthermore, the valve-opening timing or the timing for the supplementary fuel supply to fuel injection nozzles 120 can be controlled electrically. Therefore, the supplementary fuel can be fed into nozzles 120 while the pressure inside annular chambers 140 is stable before the main fuel is fed into nozzles 120. If the supplementary fuel is fed into chambers 140 at this time, it can effectively be restrained from being mixed with the main fuel in chambers 140. Thus, a pilot injection of the supplementary fuel, preceding the main fuel injection, can be reliably accomplished.

Figure 5:
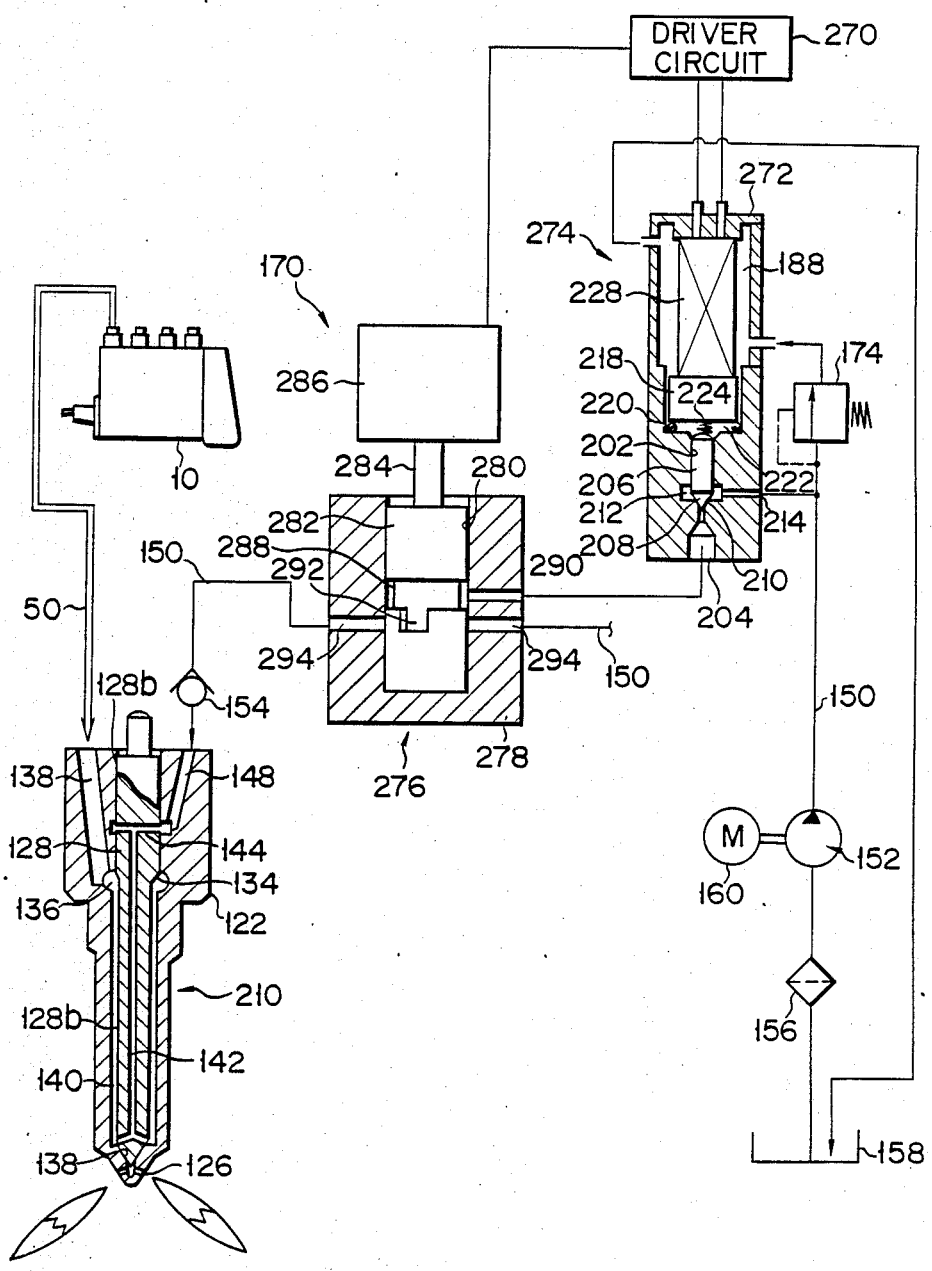
FIG. 5 is a schematic view of a fuel injection system according to a second embodiment of the invention.

In the first embodiment of the invention described above, supplementary fuel feed valves 200 corresponding in number for the engine cylinders are provided in control device 170. Device 170 may, however, be replaced with control device 270 according to a second embodiment, as shown in FIG. 5. In the description of the second embodiment to follow, like reference numerals are used to designate like members as included in the first embodiment. In the embodiment shown in FIG. 5, an inline type of fuel injection pump is employed. In this type of pump, the fuel injection timing is controlled by a timer (not shown in FIG. 5), which is provided independently of the pump.

Control device 270 includes supplementary fuel delivery unit 274 having a single supplementary fuel feed valve 200 in control housing 272, and distribution unit 276 disposed between unit 274 and fuel injection nozzle 120. In FIG. 5, relief valve 174 in unit 274 is symbolized.

Distribution unit 276 has casing 278 in which cylinder bore 280 is formed. Distribution rotor 282 is rotatably fitted in a liquid-tight manner in bore 280. Rotor 282 is coupled to electric motor 286 by means of rotating shaft 284. Motor 286 is electrically connected to driver circuit 270, whereby it is synchronously rotated the rotation of fuel injection pump 10.

Annular groove 288 is formed on the middle portion of the outer peripheral surface of distribution rotor 282. Groove 288 is always connected to inlet hole 290 formed in casing 278. Hole 290 is connected to passage 204 of delivery unit 274. Further, axially extending distribution recess 292 is formed on the outer peripheral surface of rotor 282 so as to connect with groove 288. A plurality of distribution holes 294 open into cylinder bore 280 of casing 278, arranged circumferentially at regular intervals. As rotor 282 rotates, holes 294 successively connect with recess 292. Holes 294 are connected individually to connecting passages 148 of their corresponding fuel injection nozzles 120. Thus, holes 294 are equal in number to the engine cylinders.

According to control device 270 of the second embodiment, as in the first embodiment, the supplementary fuel can be fed from delivery unit 274 into annular groove 288 of distribution unit 276 at a fixed rate and with a predetermined timing, in accordance with the operating state of the engine. When the supplementary fuel is delivered from delivery unit 274 to distribution unit 276, distribution rotor 282 of unit 276 rotates. As a result, distribution recess 292 of rotor 292 connects with one of distribution holes 294. Thus, the supplementary fuel in groove 288 is supplied to fuel injection nozzle 120 through hole 294 and supplementary fuel passage 150, as in the first embodiment. Thereafter, nozzle 120 undergoes the same process of fuel injection as in the first embodiment. As the supplementary fuel is supplied from delivery unit 274, moreover, it is distributed from distribution unit 276 to the individual fuel injection nozzles.

According to the control device of the second embodiment described above, the supplementary fuel can be distributived and supplied to fuel injection nozzles 120 by the use of a single supplementary fuel feed valve.

Figure 6:
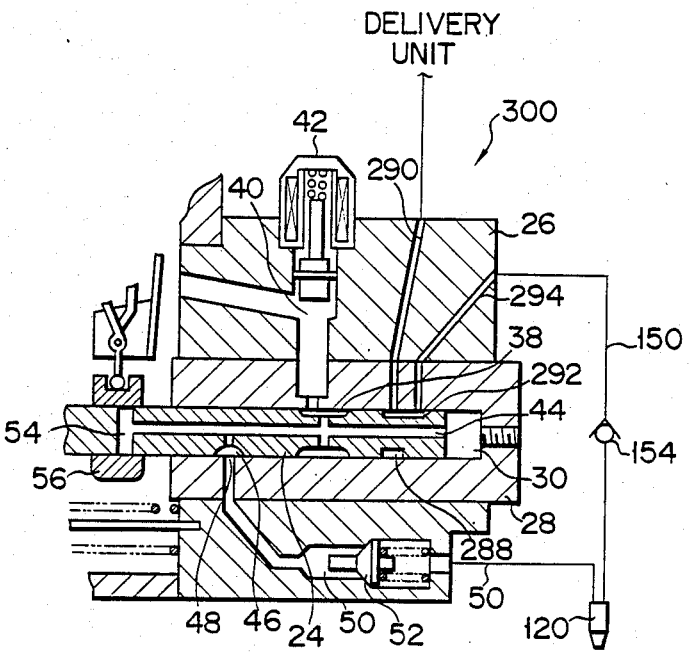
FIG. 6 is a sectional view showing a modified example in which a distribution unit of the second embodiment is incorporated in the fuel injection pump of FIG. 2.
Figure 7:
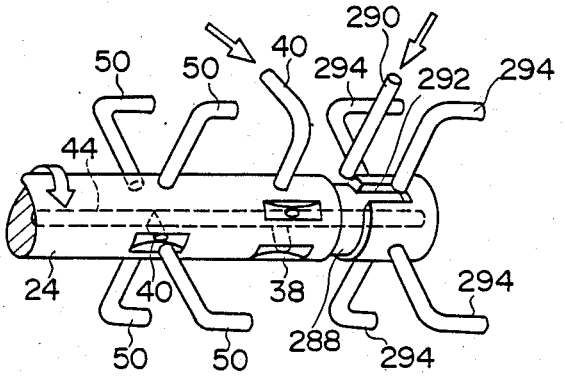
FIG. 7 is a perspective view schematically showing part of the fuel injection pump of FIG. 6.

Referring now to FIGS. 6 and 7, there is shown part of distributor-type fuel injection pump 300 according to a third embodiment which integrally incorporates distribution unit 276 of the second embodiment. In the description of pump 300 shown in FIG. 6, like reference numerals are used to designate like members or portions as included in fuel injection pump 10 of FIG. 2 and distributor unit 276 of FIG. 5. As seen from FIGS. 6 and 7, plunger 24 serves also as a substitute for distribution rotor 282 of unit 276 of FIG. 5. Annular groove 288 and distribution recess 292 are arranged on the end portion of plunger 24. Formed in distributor head 26 and cylinder 28 are passages 290 and 294 which are or can be connected to groove 288 and recess 292, respectively.

FIG. 7 is a perspective view schematically showing the positions of several passages relative to plunger 24.

The present invention is not limited to the embodiments described above. In any of the above embodiments, for example, supplementary fuel feed valves 200 can be used to include PZT stacks as actuators. However, electromagnetically-operated switch valves may be used in place of valves 200.

What is claimed is:

1. A fuel injection system for supplying a combustion chamber of a diesel engine with main and supplementary fuels, comprising:

a fuel injection nozzle through which the supplementary fuel is injected into the combustion chamber in advance of main fuel injection;

a main fuel injection pump connected to the fuel injection nozzle to supply the same with the main fuel, said pump being capable of controlling the main fuel supply in accordance with the operating state of the engine;

a supplementary fuel feed pump for delivering the supplementary fuel; and a feed device for supplying the fuel injection nozzle with the supplementary fuel delivered from the supplementary fuel feed pump, said feed device including a passage connecting the fuel injection nozzle and the supplementary fuel feed pump, adjusting means including a relief valve provided in the passage and adapted to adjust the pressure of the supplementary fuel supplied to the fuel injection nozzle to a predetermined pressure, a feed valve including a valve member for opening and closing the passage provided in that portion of the passage located nearer to the fuel injection nozzle than the adjusting means, and driving means including an actuator for electrically driving the valve member so as to control the operation of the feed valve in accordance with the operating state of the engine, said actuator having an element adapted to extend and contract when an electric field is applied thereto and removed therefrom, respectively, a piston coupled to the element, a pump chamber defined between the piston and the valve member and receiving the supplementary fuel adjusted in pressure by the adjusting means, and a spring housed in the pump chamber and adapted to push the valve member to close the passage.

2. A fuel injection system for supplying combustion chambers of a diesel engine with main and supplementary fuels, comprising:

fuel injection nozzles through which the supplementary fuel is injected into the combustion chamber prior to main fuel injection;

a main fuel injection pump connected to the fuel injection nozzles to supply the same with the main fuel, respectively, said pump being capable of controlling the main fuel supply in accordance with the operating state of the engine;

a supplementary fuel feed pump for delivering the supplementary fuel; and a feed device for distributing the fuel injection nozzles with the supplementary fuel delivered from the supplementary fuel feed pump, said feed device including passage means connecting the fuel injection nozzles and the supplementary fuel feed pump, a plurality of adjusting means, each including a relief valve for respectively adjusting the pressure of the supplementary fuel supplied to each of the fuel injection nozzles to a predetermined pressure, a plurality of feed valve means, each including valve member means for opening and closing the passage means provided in that portion of the passage means located nearer to the fuel injection nozzles than the adjusting means is, and driving means including a plurality of actuator means for electrically driving a respective valve member means so as to control the operation of the feed valve means in accordance with the operating state of the engine, each acutuator means including an element adapted to extend and contract when an electric field is applied thereto and removed therefrom, respectively, a piston coupled to the element, a pump chamber defined between the piston and the valve member means and receiving the supplementary fuel adjusted in pressure by the adjusting means, and a spring housed in the pump chamber and adapted to urge the valve member means to close the passage means.

3. The fuel injection system according to claim 1, wherein said fuel injection nozzle includes a body having an injection hole, a nozzle needle slidably fitted in the body and having a needle seat adapted to close the injection hole in cooperation with a body seat formed on the body, and a guide passage formed in the body to introduce the supplementary-near the body seat.

4. The fuel injection system according to claim 2, wherein said feed valve means includes the same number of feed valves as combustion chambers, the feed valves receiving the supplementary fuel adjusted to a predetermined pressure by the relief valve.

5. The fuel injection system according to claim 2, wherein said feed valve means includes a feed valve and a distribution unit for distributing the supplementary fuel from the feed valve to fuel injection nozzles.

6. The fuel injection system according to claim 4, wherein the distribution unit includes a casing, a distribution rotor rotatably fitted in the casing, an annular groove formed on the outer peripheral surface of the rotor, a passage connecting the groove and the feed valve, a recess formed on the outer peripheral surface of the rotor so as to be in continuous contact with the groove, the recess extending in the axial direction of the rotor, and distribution holes formed in the casing and connected individually to the fuel injection nozzles, the holes being adapted to connect successively with the recess as the rotor rotates.

7. The fuel injection system according to claim 4, wherein the feed valve includes a valve member for opening and closing the passage means, and said driving means includes an actuator for electrically driving the valve member.

8. The fuel injection system according to claim 5, wherein said main fuel injection pump is of a distributor type, and the distributing unit is integrally incorporated into said pump.

9. The fuel injection system according to claim 2, wherein said fuel injection nozzle includes a body having an injection hole, a nozzle needle slidably fitted in the body and having a needle seat adapted to close the injection hole in cooperation with a body seat formed on the body, and a guide passage formed in the body to introduce the supplementary fuel near the body seat.

10. The fuel injection system according to claim 1, wherein said main fuel injection pump is of a distributor type.

11. The fuel injection system according to claim 1, wherein said main fuel injection pump is of an in-line type.

* * * * *